US005972281A

United States Patent [19]

Stilkerieg et al.

[11] Patent Number: 5,972,281

[45] Date of Patent: Oct. 26, 1999

[54] PROCESS AND DEVICE TO AVOID CONTAMINATION OF TAPPING STEEL BY FLUSH SLAG WITH A TILTABLE CONVERTER

[76] Inventors: Berthold Stilkerieg, Mox-Uŏolgesshaesse; Friedhelm Breier, Allensteiner, both of Germany

[21] Appl. No.: 08/573,653

[22] Filed: Dec. 18, 1995

Related U.S. Application Data

[63] Continuation of application No. 08/452,712, May 30, 1995, abandoned, which is a continuation of application No. 08/345,265, Nov. 25, 1994, abandoned, which is a continuation of application No. 07/977,497, Nov. 18, 1992, abandoned.

[51] Int. Cl.[6] ..... C21B 7/12

[52] U.S. Cl. ..... 266/45; 266/272; 501/129

[58] Field of Search ..... 266/45, 271, 272; 501/128, 129, 130

[56] References Cited

U.S. PATENT DOCUMENTS 4,017,316 4/1977 Renkey et al. ..... 501/129
4,826,139 5/1989 Van Es ..... 266/272
4,828,226 5/1989 Komanecky ..... 266/272
4,877,221 10/1989 Scriven ..... 266/272

*Primary Examiner*—Scott Kastler
*Attorney, Agent, or Firm*—Foley & Lardner

[57] ABSTRACT

This invention concerns a process for the reliable avoidance of slag contamination of the converter tapping steel by flush slag. In accordance with the invention a plastic, workable stopper made of fire-proof material containing silicic and oxidic components as well as suitable binding agents is used for this purpose. The stopper is introduced so far into the tapping channel with the help of a setting device that its front surface, terminated with a funnel-shaped compression plate, almost aligns flushly with the interior side of the converter, and it fills in the diameter of the tapping channel as a result of being compressed, creating such a plane that the flush slag occurring during tipping of the converter is reliably directed past the tapping channel. Stopper systems used up to now had the disadvantage that age-dependent enlargements of the tapping channel had a detrimental effect on the functioning of the stopper. The new plastic stopper adapts to a large range of tapping channel diameters in accordance with the process used.

19 Claims, 3 Drawing Sheets

PROCESS AND DEVICE TO AVOID CONTAMINATION OF TAPPING STEEL BY FLUSH SLAG WITH A TILTABLE CONVERTER

This is a File Wrapper Continuation of application Ser. No. 08/452,712 filed May 30, 1995 abandoned, which is a Continuation of application Ser. No. 08/345,265 filed Nov. 25, 1994 abandoned, which is a Continuation of application Ser. No. 07/977,497 filed Nov. 18, 1992 abandoned.

FIELD OF THE INVENTION

This invention concerns a process and a device to avoid, or rather prevent, contamination of tapping steel by flush slag with tiltable converters.

DESCRIPTION OF PRIOR ART

Tiltable converters have a discharge opening located at a suitable spot in the converter wall above the bath level through which liquid steel is transferred into the tap ladle. In order to empty the converter, it is tipped into such a position that the steel flows through the discharge opening into the ladle. Since specifically lighter slag of various viscosities is always found on the molten metal, it first passes into the tap hole during the tilting process and thus varying quantities of flush slag end up in the tap ladle. The presence of oxygen-rich slag, frequently enriched with phosphorous or sulphur, is disadvantageous for numerous subsequent metallurgical processes. This results in the demand that converter steel be transferred to the tap ladle as free of slag as possible. This is preferably achieved by plugging the tap opening of the converter temporarily.

In this regard, a number of systems are known which are supposed to open the tapping channel only when the slag has passed the tapping channel during the tipping process. In particular, slide systems are known as closing mechanisms; but they cannot prevent flush slag entering the tapping channel. In addition, up to now stoppers made of various materials or combinations of materials have been placed outside in the tap opening or driven into it. Combinations of fibrous materials with solid bodies, plastic clay materials, wooden stoppers, and also pitch stoppers are used for the external placement and, for the internal placement, combinations of sheet metals coated with fireproof materials and sheet metal claws which are supposed to dig into the tapping channel as described in DE 39 38 687 C2.

The technically required conical or funnel-like shape of the tapping channel and the progressive wear of the fire-proof material in this area results in the premature breakdown of the stopper protection against flush slag contaminants, so that the behaviour of the stoppers cannot be controlled and, therefore, they are a negative factor. Consequently, fairly large quantities of flush slag are frequently transferred into the ladle.

SUMMARY OF THE INVENTION

The problem of this invention is to present a flush slag stopper and a process which reliably prevents large quantities of converter flush slag from being transferred into the ladle.

This problem is solved by using a suitable setting device to push a highly plastic, fire-resistant material into the tapping channel from the outside up to the area of transition to the inside of the converter and compressing it with the help of the setting device and a compressing plate made of heat-resistant materials attached to the stopper to such an extent that the diameter of the tapping pipe is completely filled in.

As a result of this working method, the geometric shape of the tapping channel, especially age-related tapping channel enlargements, are of secondary importance to the functioning of the stopper.

BRIEF DESCRIPTION OF THE DRAWINGS

The features of the present invention may best be understood by making reference to the following description taken in conjunction with the accompanying drawings, and wherein.

Figure 1:
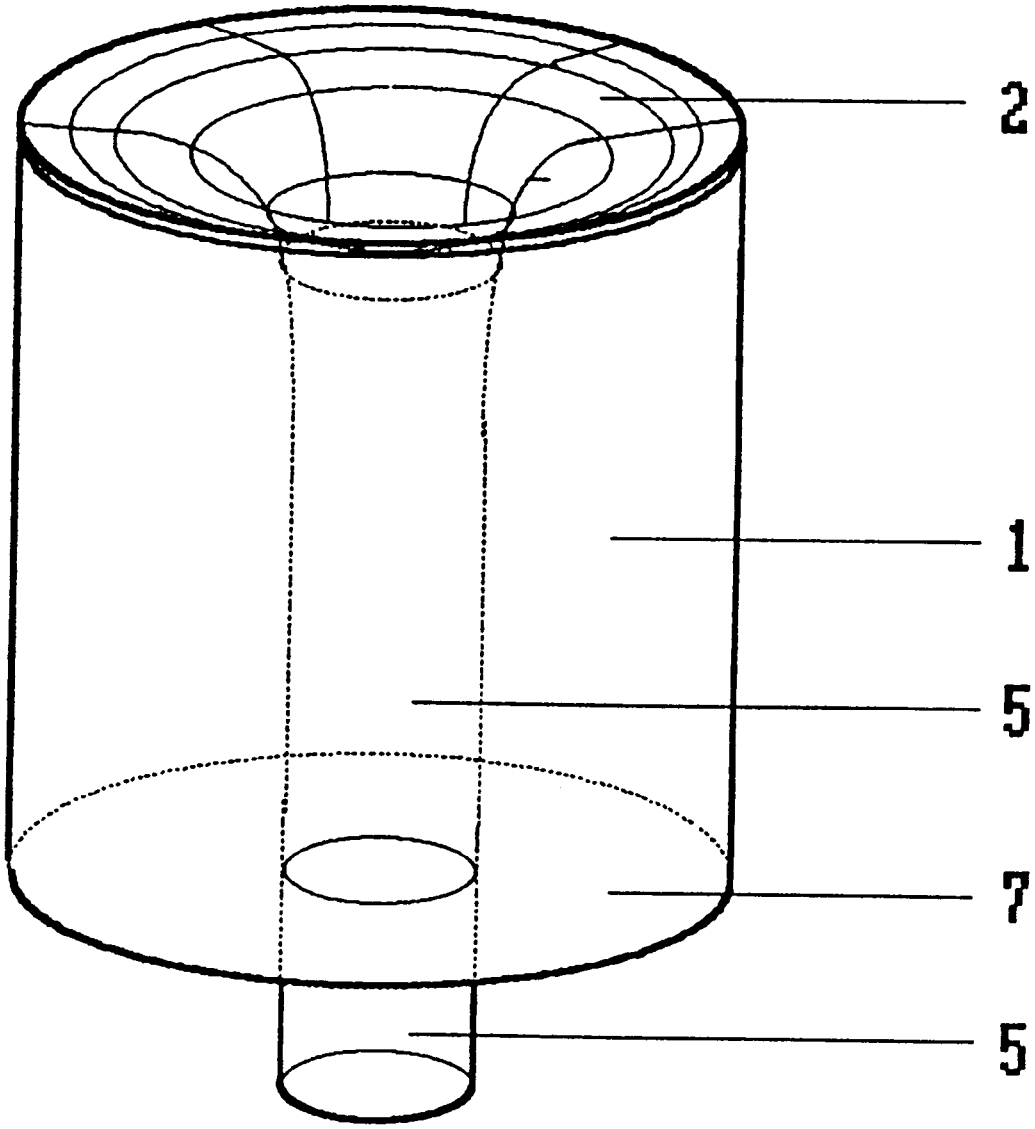
FIG. 1 is a lateral perspective view of an embodiment of a stopper.

In the inventive application, the stopper, which conforms in its fire-proof composition and plasticity to the occurring operating conditions, adheres instantaneously to the tapping channel wall, so that immediately after placement the stopper sits firmly in the tapping channel directly in the area of transition to the interior of the converter. On account of the high interior temperatures in the converter, within a short time the fire-proof material forms a sintered cap a few centimetres thick on the side facing the interior of the converter which can bear the blast pressure and the occurring vibration and shaking. In particular, the time at which the stopper is placed in the tapping channel in accordance with the invention in order to exercise its protective function is of secondary importance. Even after the flush stopper has been in the tapping pipe for several hours, the different operating processes and conditions of a converter have no negative effect whatsoever on its full functioning and protective effect. Due to its placement in the area of transition to the interior of the converter, the penetration of slag into the tapping channel during the blast process, which occurs frequently with newly lined converters, is also effectively prevented. In addition, the permanent and temporary binding agents contained in the fire-proof material of the flush stopper prevent the rest of the mass decomposing prematurely.

The cap formed towards the interior side of the converter is stable enough to direct the slag securely past the tapping channel when the converter is tipped. It collapses only when exposed to the ferrostatic pressure. Because the material adjacent to the tapping channel wall is not sintered, it is completely removed within a short time by the outflowing steel.

The fact that large masses of fire-proof material is a disadvantage of other stopper systems as mentioned in DE 39 38 687 C2 is not supported by the inventive fire-proof material mentioned. For the inventive process mentioned, merely a mass of ca. 2–3 kg fire-proof material is required to provide complete protection, even with conical tapping pipes larger than 20 cm in diameter.

The fire-proof material may be made of raw materials based on suitable compositions of silicon, aluminium, and magnesium oxides or silicates. Insulating alumosilicate or magnesium silicate as well as quartz materials in a grain size less than 3 mm are preferred.

In a preferred embodiment of the invention, the fire-resistant material should have the following composition:

| | |
|---|---|
| alumosilicate, insulating | 20–40% by weight |
| bonding clay | 20–40% by weight |
| water | 0–30% by weight |
| mineral oil | 5–20% by weight |
| plasticizer | 0.1–0.5% by weight |
| liquifier | 0.1–0.5% by weight |
| temporary binders/celluloses | 0.1–0.5% by weight |
| permanent binders/silicates | 1–2.5% by weight. |

This fire-resistant material has a density by volume of 0.8–0.9 kg/dm$^3$ and, therefore, is considerably lighter than the materials traditionally used for this purpose.

The compression plate used is made of heat-resistant material and may have any geometric shape suitable for this purpose. In a preferred embodiment of the invention, it is funnel-like in shape and has a funnel channel extended through the stopper. Among other things, this channel serves as a guide for the setting tool to compress the stopper and to centre the exiting stream of molten metal at the moment of the tapping in order to avoid the shower effect of the flowing steel. The funnel channel can have various diameters. In the case of the inventive embodiment used, the diameters are 25–38 mm; they may, however, also be larger or smaller, and the entire funnel channel may be conical. The cross-section of the funnel channel may deviate from the circular shape.

Figure 2:
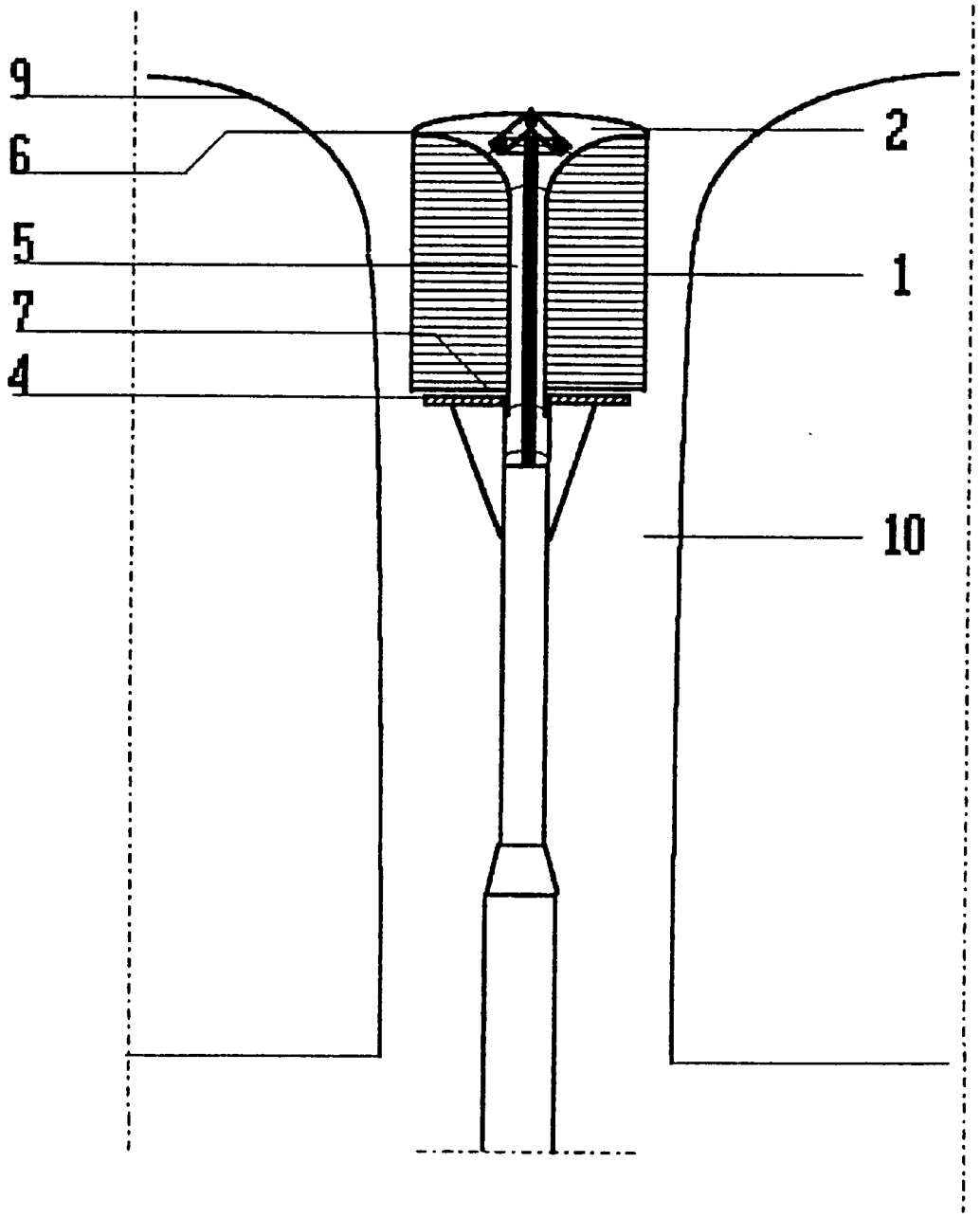
FIG. 2 is a section view of the stopper illustrated in FIG. 1 disposed in a tapping channel of a converter.
Figure 3:
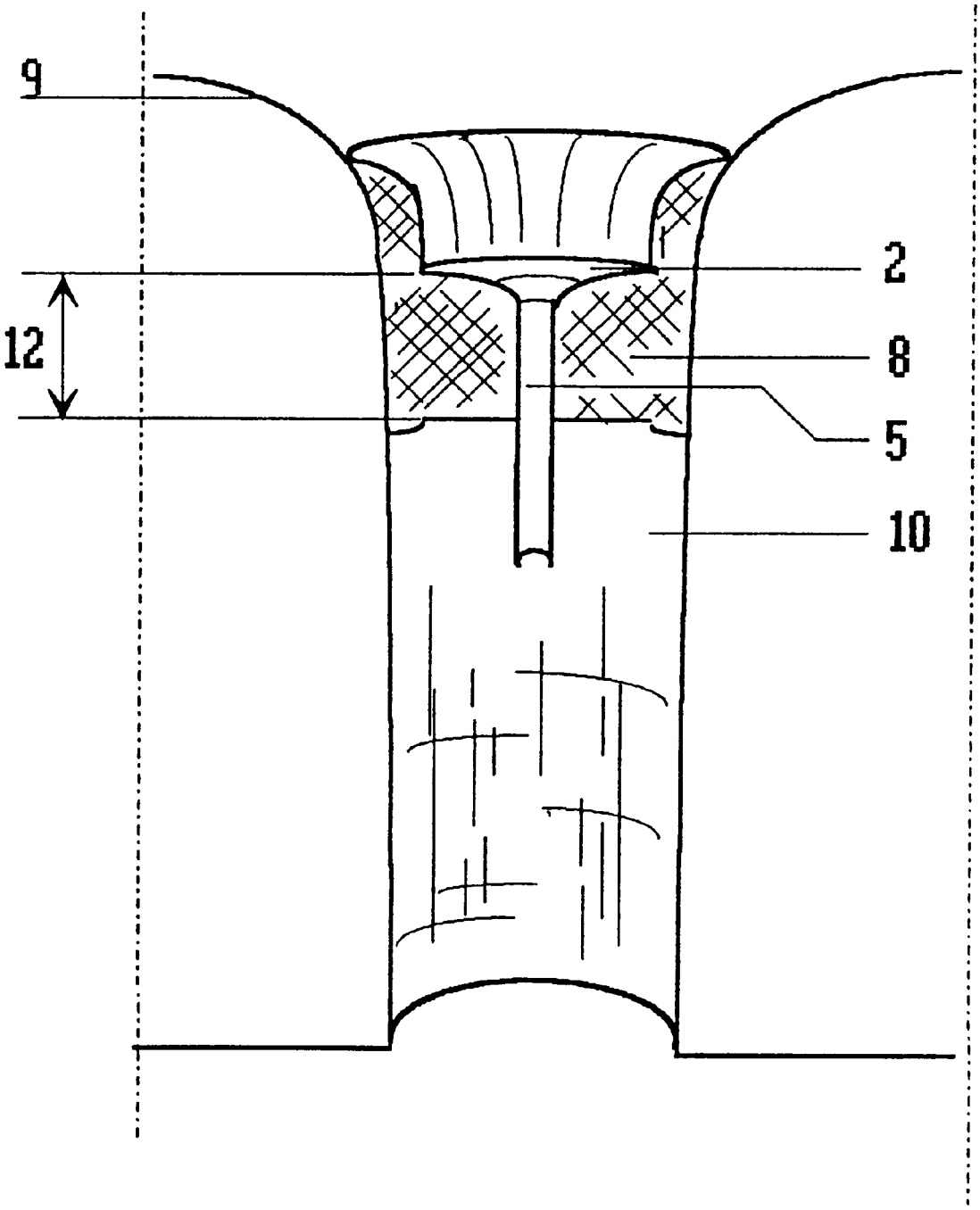
FIG. 3 is a section view showing the stopper llustrated in FIG. 1 in a compressed state.

A preferred embodiment of the invention is explained below, the diagrammatic illustrations being as follows:

FIG. 1 a lateral perspective view of an embodiment through a slag flush stopper, FIG. 2 a section through an object in accordance with FIG. 1 and positioning in the tapping channel of a converter, FIG. 3 a section though a configuration following the insertion and compressing of the object in accordance with FIG. 1.

The flush stopper illustrated in FIG. 1 is cylindrical in shape. The cross-section of the stopper need not be circular in shape.

The stopper 1 is made of a fire-resistant material and has a funnel-shaped compression plate 2 on the side towards the interior of the converter, this plate having an extended funnel channel 5 which leads through the stopper 1. In the embodiment illustrated the fire-resistant material of the stopper is composed of the following:

| | |
|---|---|
| alumosilicate, insulating | 35% by weight |
| bonding clay | 35% by weight |
| water | 20% by weight |
| mineral oil | 6.5% by weight |
| plasticizer | 0.2% by weight |
| liquifier | 0.3% by weight |
| temporary binders | 0.5% by weight |
| permanent binders | 2.5% by weight. |

Silicates were used as permanent binders, cellulose materials as temporary binders, polyelectrolytical alcohols and fatty acids as plasticizers and liquifiers. The specific gravity of the stopper is 0.8–0.9 Kg/dm$^3$.

FIG. 2 illustrates how the stopper is inserted into the tapping channel with the help of the setting device. The base plate 4 of the setting device, which conforms to the diameter of the tapping channel, is adjacent to the opposite side 7 of the compression plate.

A pulling claw 6 is introduced through the funnel channel 5 to a position above the funnel and holds the stopper for the time being until it is finally positioned in the tapping channel. The stopper is introduced so far into the tapping channel with the help of the setting device that its compression plate surface almost aligns flush with the interior side of the converter 9. The lever system of the setting device is used to draw the pulling claw 6 to the compression plate 2, producing pressure on the stopper material 1, which deforms until the diameter of the tapping hole 10 is completely filled in. FIG. 3 illustrates a compressed stopper 8 in the tapping channel 10. With the help of the setting device the thickness of the stopper base 12 in FIG. 3 is always adhered to for every tapping channel diameter of a converter, so that it is guaranteed that the behaviour of the opening is reproducible. Stopper material not required to fill in the tapping channel diameter is compressed to the tapping channel wall with the help of the compression plate as shown in FIG. 3.

On account of the high radiant heat on the interior side of the converter, the compression plate melts and sinters with the fire-proof material to a solid cap. This cap bears the blast pressure and the resulting vibration and shaking. The remaining fire-proof insulating material solidifies to such an extent that it remains stable in the tapping channel. It does not sinter with the wall of the tapping channel. The sintered cap is so stable that it directs the flush slag reliably over the tapping hole when the converter is tipped and only collapses under the ferrostatic pressure. The remaining stopper material is removed within a few seconds by the outflowing steel.

On account of the low material quantities, only a few foreign substances reach the tapping ladle. The inventive embodiment and application guarantee a high degree of reliability in the functioning of the flush stopper, even where it is exposed to heat for periods longer than two hours. Where stationary slag measurements were carried out in tapping ladles of 100–250 t capacity, significant quantities of flush slag could no longer be detected in 200 test relinings.

We claim:

1. A plastic, workable flush slag stopper for converters, said stopper including:

a stopper body comprising a primary insulating material and a binding agent, the body having lengthwise channel extending therethrough; and a compression plate disposed on an end face of the stopper body, which compression plate is capable of compressing the stopper body between itself and another plate disposed adjacent an opposite end face of the stopper body so that the stopper body expands radially into conforming contact with a converter tap hole wall, and which compression plate is capable of melting under radiant heat associated with converters and sintering to form a solid cap effective to fill the channel and, in combination with the stopper body, prevent flow of slag from the converter through the tap hole in which the stopper is disposed, and yet collapse under ferro-static pressure.

2. A stopper in accordance with claim 1 wherein said compression plate is shaped in the form of a funnel having a narrow end and a wide end, said funnel being convex in the direction of its narrow end, said narrow end discharging into the channel.

3. A stopper according to claim 2, wherein the narrow end has an outer diameter equal to the diameter of the channel and thereby prevents collapse of the channel during compression of the stopper body.

4. A stopper according to claim 1, wherein the primary insulating material is selected from the group consisting of silicon oxides, aluminium oxides, magnesium oxides, alumosilicate, and magnesium silicate.

5. A stopper according to claim 4, wherein the primary insulating material has a grain size of less than 3 mm.

6. A stopper according to claim 1, wherein the fire-resistant stopper body consists essentially of:

20–40% by weight of alumosilicate as an insulator,

20–40% by weight of bonding clay,

0–30% by weight of water,

5–20% by weight of mineral oil, 0.1–3% by weight of plasticizer, 0.1–2% by weight of liquifier, 0.1–2% by weight of temporary binders, and 0.1–5% by weight of permanent binders.

7. A stopper according to claim 6, wherein the fire-resistant material has a density by volume of 0.8 to 0.9 kg/dm$^3$.

8. A process for inserting a stopper in the tap hole of a converter for avoiding contamination of converter tapping steel by large quantities of flush slag during tapping, comprising the steps of:

providing a stopper including a stopper body having an open lengthwise channel extending therethrough and a compression plate at an inner end face of the stopper body, the stopper body comprising a fire-resistant material;

providing a setting device including a base plate and a pulling claw, the pulling claw extending through the base plate and movable relative thereto;

bring the base plate into engagement with an outer end face of the stopper body;

inserting the pulling claw through the channel in the stopper body so that the stopper is mounted between the base plate and pulling claw with the compression plate adjacent the pulling claw;

inserting the stopper into the tap hole with the compression plate facing the interior of the converter; and drawing the pulling claw toward the compression plate, thereby moving the compression plate toward the base plate and displacing stopper material radially outwardly until the diameter of the tap hole is completely filled in, wherein upon exposure to heat from the converter, the stopper melts and sinters to form a cap that prevents leakage of slag through the channel.

9. A process according to claim 8, including positioning the stopper in the tap hole so that the compression plate end aligns almost flush with an interior wall of the converter.

10. A process according to claim 8, wherein the compression plate further comprises a convex, funnel-shaped end portion which overlies a similarly shaped end portion of the stopper body, and a tubular portion which extends from a narrow end of the funnel-shaped portion axially through the channel in the stopper body, and the setting device engages the funnel-shaped portion of the compression during the step of drawing the pulling claw.

11. In combination, a plug for sealing a tap-hole of a tipping converter, and a setting device for setting a said plug in said tap-hole, said plug being fabricated from a mouldable material, and having a central longitudinal bore formed therein, and a funnel-shaped cap aligned with said bore on the end of said plug intended to be placed at the interior end of a said tap-hole, said cap being fabricated from a material that sinters upon exposure to heat to prevent slag from flowing through said tap-hole, but which melts under ferrostatic pressure to permit steel to flow through said tap-hole, said setting device including a collapsible drawclaw that can extend through said bore and cap and be retracted against said cap to draw said cap into said plug, thereby to radially expand said plug into a sealing engagement with said tap-hole.

12. The combination of claim 11, in which said plug is cylindrical.

13. The combination of claim 12, in which said funnel-shaped cap extends axially inwardly from the end of said plug, and merges with said bore.

14. The combination of claim 13, wherein said setting device includes a radially extending base plate spaced from said drawclaw, for stabilizing the outer face of said plug when said drawclaw is retracted against said funnel-shaped cap.

15. The combination of claim 14, wherein said plug is made from a fire-retardant mixture of:

| | |
|---|---|
| 20 to 40 wt % | Aluminosilicate |
| 20 to 40 wt % | bonding clay |
| and | |
| 0 to 30 wt % | water |
| 5 to 20 wt % | oil |
| 0.5 to 3 wt % | plasticizer |
| 0.1 to 2 wt % | liquefier |
| 0.1 to 2 wt % | temporary binding agent |
| 0.1 to 5 wt % | permanent binding agent |

and has a density of 0.8–0.9 kg/dm$^3$.

16. The combination of claim 15, wherein said plug has a grain size of less than 3 mm.

17. The combination of claim 16, wherein said temporary binding agents are cellulose materials, said permanent binding agents are silicates, said plasticizers are polyelectrolyte alcohols, and said liquefiers are fatty acids.

18. The combination of claim 11, wherein said bore if from 25 to 38 mm, said tap-hole having a diameter of about 20 cm.

19. A process for setting a plug in a tap-hole of a tipping converter comprising the steps of positioning the combination plug and setting device described in claim 14 in the said tap-hole, with the inner face of a said plug at about the inside surface of a said converter, and retracting the drawclaw thereof toward the said radially extending base plate, until said plug expands radially to fill said tap-hope, and withdrawing said drawclaw from said plug.

* * * * *